US011294333B2

(12) United States Patent
Ozawa

(10) Patent No.: US 11,294,333 B2
(45) Date of Patent: Apr. 5, 2022

(54) ROTARY BEZEL EQUIPPED TIMEPIECE

(71) Applicant: SEIKO EPSON CORPORATION, Tokyo (JP)

(72) Inventor: Noriaki Ozawa, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 490 days.

(21) Appl. No.: 16/215,434

(22) Filed: Dec. 10, 2018

(65) Prior Publication Data

US 2019/0179265 A1 Jun. 13, 2019

(30) Foreign Application Priority Data

Dec. 11, 2017 (JP) ..... JP2017-236738

(51) Int. Cl.
*G04B 19/28* (2006.01)

(52) U.S. Cl.
CPC ..... *G04B 19/283* (2013.01)

(58) Field of Classification Search
CPC ..... G04B 19/283; G04B 19/28
See application file for complete search history.

(56) References Cited

U.S. PATENT DOCUMENTS 2,875,574 A * 3/1959 Dinstman ..... G04B 37/081 368/291
4,479,724 A * 10/1984 Matsumoto ..... G04B 19/283 368/291
6,616,329 B1 9/2003 Sasaki et al.
2004/0141424 A1 7/2004 Hartmann et al.
2007/0217293 A1 9/2007 Takasawa
2009/0040882 A1 2/2009 Hiranuma et al.
2013/0021880 A1* 1/2013 Doi ..... G04B 3/041 368/206
2013/0329536 A1 12/2013 Silvant

FOREIGN PATENT DOCUMENTS

| | | | |
|---|---|---|---|
| CN | 1288533 | A | 3/2001 |
| CN | 101037773 | A | 9/2007 |
| JP | S57-14887 | U | 1/1982 |
| JP | S58-146982 | U | 10/1983 |
| JP | S61-245082 | A | 10/1986 |
| JP | H04-024090 | U | 2/1992 |
| JP | 2004-205515 | A | 7/2004 |
| JP | 2009-042039 | A | 2/2009 |
| JP | 2013-253973 | A | 12/2013 |
| JP | 2015-108512 | A | 6/2015 |

OTHER PUBLICATIONS

Abstract—JP 61-2415082A Sep. 26, 2021.*
Embedded—dictionary.com—Sep. 26, 2021.*

* cited by examiner

*Primary Examiner* — Sean Kayes
(74) *Attorney, Agent, or Firm* — Oliff PLC

(57) ABSTRACT

A rotary bezel equipped timepiece includes a glass frame that holds a windshield member, a rotary bezel so provided as to be rotatable relative to the glass frame, a resin member attached to the outer circumferential surface of the glass frame, and a gasket disposed between the resin member and the inner circumferential surface of the rotary bezel.

10 Claims, 4 Drawing Sheets

ROTARY BEZEL EQUIPPED TIMEPIECE

BACKGROUND

1. Technical Field

The present invention relates to a rotary bezel equipped timepiece.

2. Related Art

There is a known rotary bezel equipped timepiece including a rotary bezel, such as a diver's watch and a sport watch. The rotary bezel is a bezel located around a cover glass plate and so attached as to be rotatable, and markings and other objects corresponding to an indication hand of the timepiece are displayed on the surface of the bezel. The thus configured rotary bezel, when it is so rotated as appropriate that the relationship between the markings and the indication hand is set, can provide, for example, the function of allowing a user to readily read elapsed time from a certain point of time.

As an example of the rotary bezel equipped timepiece, there is a proposed timepiece apparatus capable of suppressing looseness of the rotary bezel so that the rotary bezel can be readily rotated (JP-A-2015-108512).

The timepiece apparatus described in JP-A-2015-108512 includes a case body, a glass frame that holds a windshield member, and a rotary bezel so provided as to be rotatable relative to the case body, and a gasket is provided between the outer circumferential surface of the glass frame and the inner circumferential surface of the rotary bezel. The gasket allows a decrease in the area where the rotary bezel is in contact with the glass frame, and the elastic force produced by the gasket suppresses the looseness, whereby the rotary bezel can be readily rotated.

In the timepiece apparatus described in JP-A-2015-108512, the rotary bezel and the glass frame are each made of a metal or ceramic material in some cases. In such cases, when the rotary bezel is rotated, friction between the rotary bezel made of a metal or ceramic material and the gasket made of a rubber material causes a stick-slip phenomenon in some cases. When the stick-slip phenomenon occurs, the rotary bezel operation torque becomes unstable, resulting in a problem of non-smooth operation of the rotary bezel.

SUMMARY

An advantage of some aspects of the invention is to provide a rotary bezel equipped timepiece that does not allow the stick-slip phenomenon to be likely to occur when the rotary bezel is rotated.

A rotary bezel equipped timepiece according to an aspect of the invention includes a glass frame that holds a windshield member, a rotary bezel so provided as to be rotatable relative to the glass frame, a resin member attached to an outer circumferential surface of the glass frame, and a gasket disposed between the resin member and an inner circumferential surface of the rotary bezel.

In the aspect of the invention, since the resin member is attached to the outer circumferential surface of the glass frame, and the gasket is disposed between the resin member and the inner circumferential surface of the rotary bezel, the gasket and the resin member slide against each other when the rotary bezel is rotated. The resin member can be made of a material that reduces frictional force produced at the portion that slides against the gasket as compared with a metal or ceramic material used as the material of the glass frame. The thus formed resin member allows the stick-slip phenomenon to be unlikely to occur, whereby the rotary bezel can be smoothly operated.

A rotary bezel equipped timepiece according to another aspect of the invention includes a glass frame that holds a windshield member, a rotary bezel so provided as to be rotatable relative to the glass frame, a resin member attached to an inner circumferential surface of the rotary bezel, and a gasket disposed between the resin member and an outer circumferential surface of the glass frame.

In the aspect of the invention, since the gasket is disposed between the resin member and the outer circumferential surface of the glass frame, the gasket and the resin member slide against each other when the rotary bezel is rotated. The thus disposed gasket allows the stick-slip phenomenon to be unlikely to occur, whereby the rotary bezel can be smoothly operated, as in the case described above.

In the rotary bezel equipped timepiece according to the aspect of the invention, it is preferable that the resin member is made of a fluorine resin.

According to the aspect of the invention with this configuration, the resin member can be made of a fluorine resin, such as polytetrafluoroethylene. A fluorine resin, which has a small friction coefficient, allows reduction in the frictional force produced along the portion where the gasket and the resin member slide against each other. The thus formed resin member allows the stick-slip phenomenon to be more unlikely to occur.

In the rotary bezel equipped timepiece according to the aspect of the invention, it is preferable that the rotary bezel is rotatable in opposite directions relative to the glass frame.

According to the aspect of the invention with this configuration, the rotary bezel can be rotated in opposite directions relative to the glass frame. Therefore, to align letters, markings, and other objects displayed on the surface of the rotary bezel with the direction pointed with an indication hand, the rotary bezel can be rotated in the direction that requires a smaller amount of operation. The operability of the rotary bezel can therefore be improved.

In the rotary bezel equipped timepiece according to the aspect of the invention, it is preferable that at least one of a letter, a numeral, a symbol, and a marking is displayed as information on the rotary bezel.

According to the aspect of the invention with this configuration, information measured with a sensor provided in an electronic timepiece can be pointed with an indication hand along with the information displayed on the rotary bezel. For example, the rotary bezel equipped timepiece can have the function as a simple orientation indicator by providing the rotary bezel equipped timepiece with an orientation sensor and displaying a letter or a marking representing an orientations are displayed as the information. In this case, a user can readily check the orientation at the current location.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

A rotary bezel equipped timepiece 1 according to a first embodiment of the invention will be described below with reference to the drawings.

Figure 1:
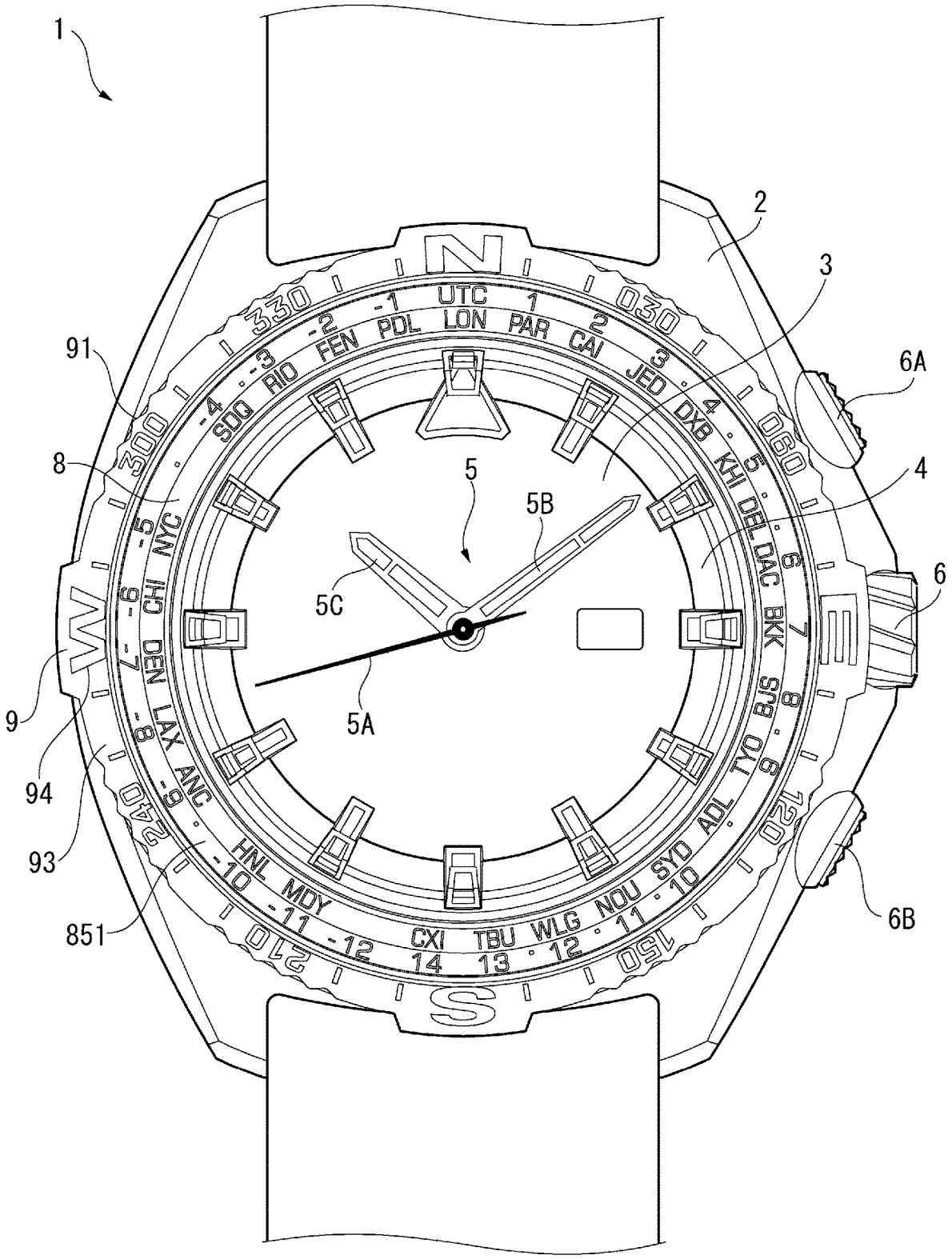
FIG. 1 is a plan view showing a rotary bezel equipped timepiece according to a first embodiment of the invention.
Figure 2:
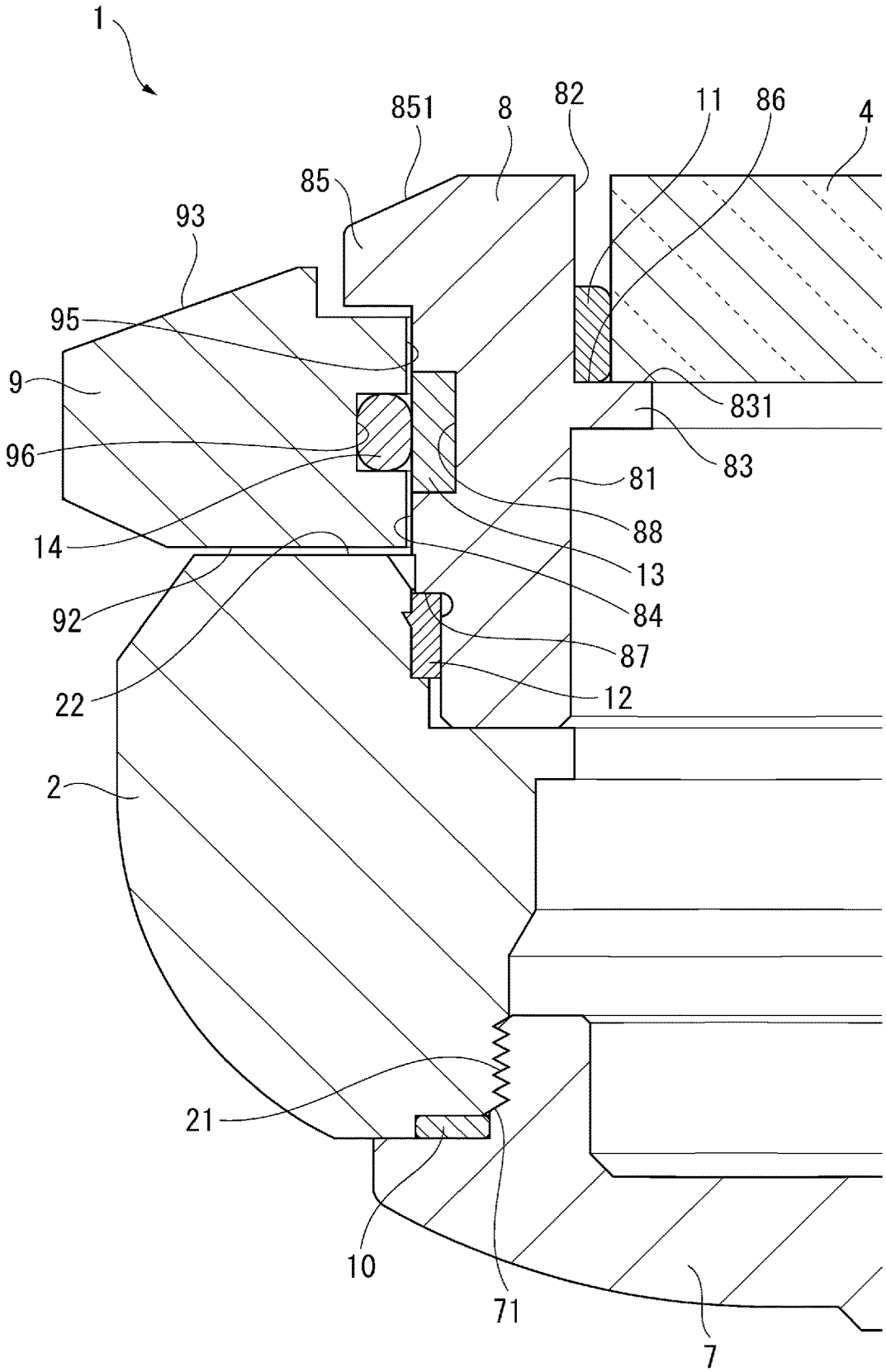
FIG. 2 is an enlarged cross-sectional view of a glass frame portion of the rotary bezel equipped timepiece according to the first embodiment.

FIG. 1 is a plan view showing the rotary bezel equipped timepiece 1 according to the present embodiment. FIG. 2 is an enlarged cross-sectional view of a glass frame portion of the rotary bezel equipped timepiece 1.

Schematic Configuration of Rotary Bezel Equipped Timepiece

The rotary bezel equipped timepiece 1 includes a flat cylindrical case body (barrel) 2, as shown in FIGS. 1 and 2.

A dial 3 is disposed in the case body 2, and a cover glass plate 4, which is the windshield member according to an aspect of the invention, is so disposed as to cover the dial 3. Indication hands 5 are disposed on the front side of the dial 3, and the indication hands 5 include a second hand 5A, a minute hand 5B, and an hour hand 5C. That is, displayed time can be visually recognized through the cover glass plate 4 from the front side of the timepiece.

A movement that is not shown but drives the indication hands 5 is accommodated in the case body 2.

A crown 6 and two buttons 6A and 6B for adjusting and setting the indication hands 5 are disposed on the side surface of the case body 2.

A case back 7, which covers an opening of the case body 2, is disposed on the timepiece rear side of the case body 2. The case back 7 includes a male thread 71, which engages with a female thread 21, which is engraved in the case body 2. The case back 7 is therefore so provided as to be attachable to and detachable from the case body 2 via a waterproof gasket 10.

The rotary bezel equipped timepiece 1 includes a glass frame 8 and a rotary bezel 9 as exterior parts as well as the case body 2, the cover glass plate 4, and the case back 7 described above.

The glass frame 8 and the rotary bezel 9 in the present embodiment will be more specifically described with reference to FIG. 2.

Glass Frame

The glass frame 8 is made of a metal or ceramic material and holds the cover glass plate 4. That is, the glass frame 8 is formed in an annular shape and disposed along the outer circumferential edge of the cover glass plate 4.

The glass frame 8 includes a roughly cylindrical tubular section 81, a support section 83, which protrudes from an inner circumferential surface 82 of the tubular section 81, and a holding section 85, which protrudes from an upper end portion of an outer circumferential surface 84 of the tubular section 81.

The inner circumferential surface 82 of the tubular section 81 and an upper surface 831 of the support section 83 form an engaging stepped section 86 having a roughly L-letter-shaped cross section. An annular plastic gasket 11 is disposed on the engaging stepped section 86, and the cover glass plate 4 is press-fit to the inner circumference of the plastic gasket 11. That is, the configuration in which the plastic gasket 11 is press-fit between the cover glass plate 4 and the tubular section 81 fixes the cover glass plate 4 to the glass frame 8 and ensures waterproofness.

A lower end portion of the outer circumferential surface 84 of the tubular section 81 forms an engaging stepped section 87 having a roughly inversed-L-letter-shaped cross section and having a stepped portion facing the interior in the radial direction. A glass frame gasket 12 is disposed on the engaging stepped section 87, and the tubular section 81 on which the glass frame gasket 12 is disposed is press-fit to the inner circumference of the case body 2. That is, the configuration in which the glass frame gasket 12 is press-fit between the glass frame 8 and the case body 2 fixes the glass frame 8 to the case body 2 and ensures waterproofness.

The holding section 85 is so located as to protrude toward the front surface of the rotary bezel 9 and restricts movement of the rotary bezel 9 toward the timepiece front side. That is, the holding section 85 positions the rotary bezel 9 in the timepiece thickness direction (axial direction of case body 2).

Letters representing the names of representative city in the world time zone and numerals representing time differences from the coordinated universal time (UTC) are displayed on an upper surface 851 of the holding section 85, as shown in FIG. 1. That is, the rotary bezel equipped timepiece 1 according to the present embodiment has a world time function.

Referring back to FIG. 2, a recessed groove 88 having a roughly rectangular cross section is formed in the outer circumferential surface 84 of the tubular section 81 and continuously extends in the circumferential direction. A resin member 13, which is made of a fluorine resin, such as polytetrafluoroethylene, is so attached as to be press-fit into the recessed groove 88. The resin member 13 is formed in an annular shape having a roughly rectangular cross section and so attached to the recessed groove 88 that the outer circumferential surface of the resin member 13 is roughly flush with the outer circumferential surface 84 of the tubular section 81. The resin member 13 may instead be so attached that the inner circumferential surface thereof is bonded to the outer circumferential surface of the recessed groove 88.

Rotary Bezel

The rotary bezel 9 is an annular member made of a metal or ceramic material, and operation sections 91, which each have indentations alternately arranged in the circumferential direction, are formed on the outer circumference of the rotary bezel 9, as shown in FIG. 1.

Referring back to FIG. 2, the rotary bezel 9 is so disposed along the outer circumferential surface 84 of the glass frame 8 as to face an upper surface 22 of the case body 2.

Letters, symbols, and markings representing orientations are displayed as information 94 on an upper surface 93 of the rotary bezel 9, as shown in FIG. 1. That is, the rotary bezel equipped timepiece 1 according to the present embodiment is provided with an orientation sensor, and the second hand 5A points the north direction in response to an orientation sensor measurement instruction. The rotary bezel equipped timepiece 1 therefore has the function as a simple orientation indicator. The rotary bezel 9 is so disposed as to be rotatable in opposite directions relative to the glass frame 8. A user can therefore readily check the orientation at the current location by operating the rotary bezel 9 in the direction that requires a smaller amount of operation to align the letter "N" representing the north direction, which is part of the information 94, with the direction pointed with the second hand 5A.

Referring back to FIG. 2, a recessed groove 96 having a roughly rectangular cross section is formed in an inner circumferential surface 95 of the rotary bezel 9 and in a position facing the recessed groove 88, to which the resin member 13 is attached. The recessed groove 96 is so formed that the dimension thereof in the timepiece thickness direction (height) is smaller than that of the recessed groove 88. That is, the recessed groove 88 is so formed that the dimension thereof in the timepiece thickness direction is greater than that of the recessed groove 96, with the upper end of the opening of the recessed groove 88 so located as to be shifted from the upper end of the opening of the recessed groove 96 toward the timepiece front side, and the lower end of the opening of the recessed groove 88 so located as to be shifted from the lower end of the opening of the recessed groove 96 toward the timepiece rear side. A gasket 14 formed of an elastic member made, for example, of a synthetic resin or rubber material, is disposed in the recessed groove 96. That is, the rotary bezel 9 is fit to the outer circumferential surface 84 of the glass frame 8 via the gasket 14. The elastic force produced by the gasket 14 can therefore eliminate any gap between the inner circumferential surface 95 of the rotary bezel 9 and the outer circumferential surface 84 of the glass frame 8, whereby looseness of the rotary bezel 9 with respect to the glass frame 8 can be suppressed, and the rotary bezel 9 can be held in an arbitrary position relative to the glass frame 8.

Since the resin member 13 is attached to the recessed groove 88 of the glass frame 8, and the gasket 14 is disposed between the resin member 13 and the inner circumferential surface 95 of the rotary bezel 9, the resin member 13 and the gasket 14 slide against each other when the rotary bezel 9 is rotated. The resin member 13 is made of a fluorine resin, such as polytetrafluoroethylene, as described above. Since a fluorine resin has a small friction coefficient, the resin member 13 made of such a fluorine resin, as compared with the glass frame 8, which is made of a metal or ceramic material, allows reduction in the frictional force produced along the portion where the resin member 13 and the gasket 14 slide against each other. Therefore, when the rotary bezel 9 is rotated, variation in the running torque can be reduced, whereby the stick-slip phenomenon is unlikely to occur.

Further, the resin member 13 is attached to the recessed groove 88, which is larger than the recessed groove 96, in which the gasket 14 is disposed, in the timepiece thickness direction. Therefore, even when the position of the rotary bezel 9 in the timepiece thickness direction with respect to the glass frame 8 is shifted due, for example, to variation in a rotary bezel spring, the resin member 13 and the gasket 14 in the glass frame 8 are reliably allowed to slide against each other. The attachment of the resin member 13 therefore allows the stick-slip phenomenon to be more reliably unlikely to occur when the rotary bezel 9 is rotated.

Evaluation Test

In the present embodiment, an evaluation test on the torque required to operate the rotary bezel 9 was conducted in a case where the resin member 13 was attached to the outer circumferential surface 84 of the glass frame 8. A detailed description will next be made of results of the evaluation test with reference to Examples and Comparative Examples.

Evaluation Test Method

As the evaluation test on the torque required to operate the rotary bezel 9, the starting torque and the running torque were measured with the amount of compression of the gasket 14 changed. The amount of compression of the gasket 14 is the difference in dimension between the radius of the inner circumference of the gasket 14 disposed in the recessed groove 96 in the state in which the rotary bezel 9 is not fit to the glass frame 8 and the radius of the outer circumference of the resin member 13 that slides against the gasket 14. Typically, when the amount of compression of the gasket increases, the gasket elastically deformed by a greater amount, and the elastic force produced by the gasket increases accordingly, resulting in an increase in the frictional force produced at the sliding portion. The starting torque and the running torque necessary for the rotation of the rotary bezel 9 therefore increases.

The starting torque was so measured that the rotary bezel 9 was first stationary relative to the glass frame 8 and then rotated. The running torque was measured as follows: The torque was measured when the rotary bezel 9 was rotated rightward (clockwise) relative to the glass frame 8 (running torque (rightward)); and the torque was measured when the rotary bezel 9 was rotated leftward (counterclockwise) relative to the glass frame 8 (running torque (leftward)).

In Comparative Examples A and B, the test was so performed that no resin member 13 was attached to the outer circumferential surface 84 of the glass frame 8. That is, the test in which the gasket 14 and the glass frame 8 slide directly against each other was performed as Comparative Examples. The amount of compression of the gasket 14 in this case is the difference in dimension between the radius of the inner circumference of the gasket 14 in the state described above and the radius of the outer circumference of the glass frame 8 that slides against the gasket 14 (radius of outer circumferential surface 84).

The amount of compression of the gasket 14 was so adjusted as to be 0.02 mm in Comparative Example A, 0.05 mm in Comparative Example B, 0.07 mm in Example C, and 0.10 mm in Example D. That is, the adjustment was so made that the amount of compression was greater in Examples C and D, in which the resin member 13 was attached, than in Comparative Examples A and B.

Results of Evaluation Test

Figure 3:
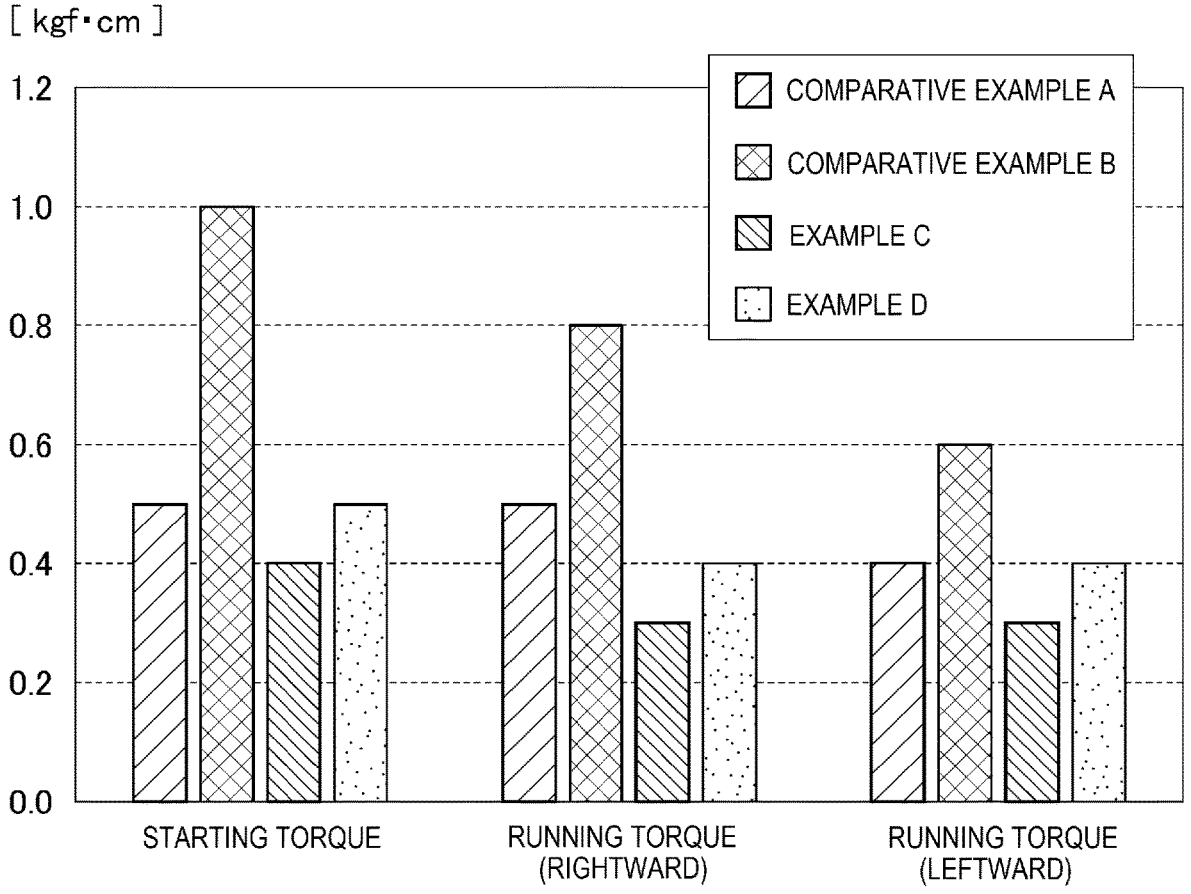
FIG. 3 shows graphs illustrating results of evaluation of starting torque and running torque in Examples and Comparative Examples.

FIG. 3 shows graphs illustrating results of the evaluation test. The vertical axis of FIG. 3 represents measured values of the starting torque and the running torque (unit: kgf·cm).

The results of the test shown in FIG. 3 show that the measured values of the starting torque in Comparative Examples A and B were 0.5 kgf·cm (about 0.049 N·m) and 1.0 kgf·cm (about 0.098 N·m), respectively. On the other hand, the measured values of the starting torque in Examples C and D were 0.4 kgf·cm (about 0.039 N·m) and 0.5 kgf·cm (about 0.049 N·m), respectively.

The results show that the starting torque was suppressed to small values although the amounts of compression of the gasket 14 in Examples C and D were greater than those in the Comparative Examples A and B. The results further show that the starting torque notably increases as the amount of compression of the gasket 14 increases in Comparative Examples A and B, and that the starting torque hardly increases as the amount of compression of the gasket 14 increases in Examples C and D. That is, the results show that the configuration in which the gasket 14 and the resin member 13 slide against each other, as in Examples C and D, allows the starting torque to decrease to a small value even when the amount of compression of the gasket 14 increases.

The results of the measurement of the running torque show that the measured values in the rightward and leftward rotations differ from each other by about 0.1 to 0.2 kgf·cm in Comparative Examples A and B, and that the measured values in rightward and leftward rotations have the same value in Examples C and D. That is, the results shows that the configuration in which the gasket 14 and the resin member 13 slide against each other reduces the rotational-direction-related variation in running torque.

The test results described above show that attaching the resin member 13 to the outer circumferential surface 84 of the glass frame 8 can not only suppress the starting torque required to initiate the rotation of the rotary bezel 9 to a small value even when the amount of compression of the gasket 14 is large but stabilize the running torque. That is, the attachment of the resin member 13 allows the stick-slip phenomenon to be unlikely to occur when the rotary bezel 9 is rotated.

Effects of First Embodiment

The present embodiment described above can provide the following effects.

In the present embodiment, since the resin member 13 is attached to the outer circumferential surface 84 of the glass frame 8, and the gasket 14 is disposed between the resin member 13 and the inner circumferential surface 95 of the rotary bezel 9, the gasket 14 and the resin member 13 slide against each other when the rotary bezel 9 is rotated. The resin member 13 is made of a fluorine resin, such as polytetrafluoroethylene. A fluorine resin, which has a small friction coefficient, allows reduction in the frictional force produced along the portion where the resin member 13 and the gasket 14 slide against each other. The thus formed resin member 13 allows the stick-slip phenomenon to be unlikely to occur, whereby the rotary bezel 9 can be smoothly operated.

In the present embodiment, the rotary bezel 9 can be rotated in opposite directions relative to the glass frame 8. Therefore, to align the information 94 displayed on the upper surface 93 of the rotary bezel 9 with the direction pointed with any of the indication hands 5, the rotary bezel 9 can be rotated in the direction that requires a smaller amount of operation. The operability of the rotary bezel 9 can therefore be improved.

In the present embodiment, since the rotary bezel equipped timepiece 1 is provided with the orientation sensor, and the letters and markings representing the orientations are displayed as the information 94, the rotary bezel equipped timepiece 1 can have the function as a simple orientation indicator. The user can therefore readily check the orientation at the current location by rotating the rotary bezel 9 to align the letter N, which is part of the information 94, with the direction pointed with the second hand 5A.

Second Embodiment

Figure 4:
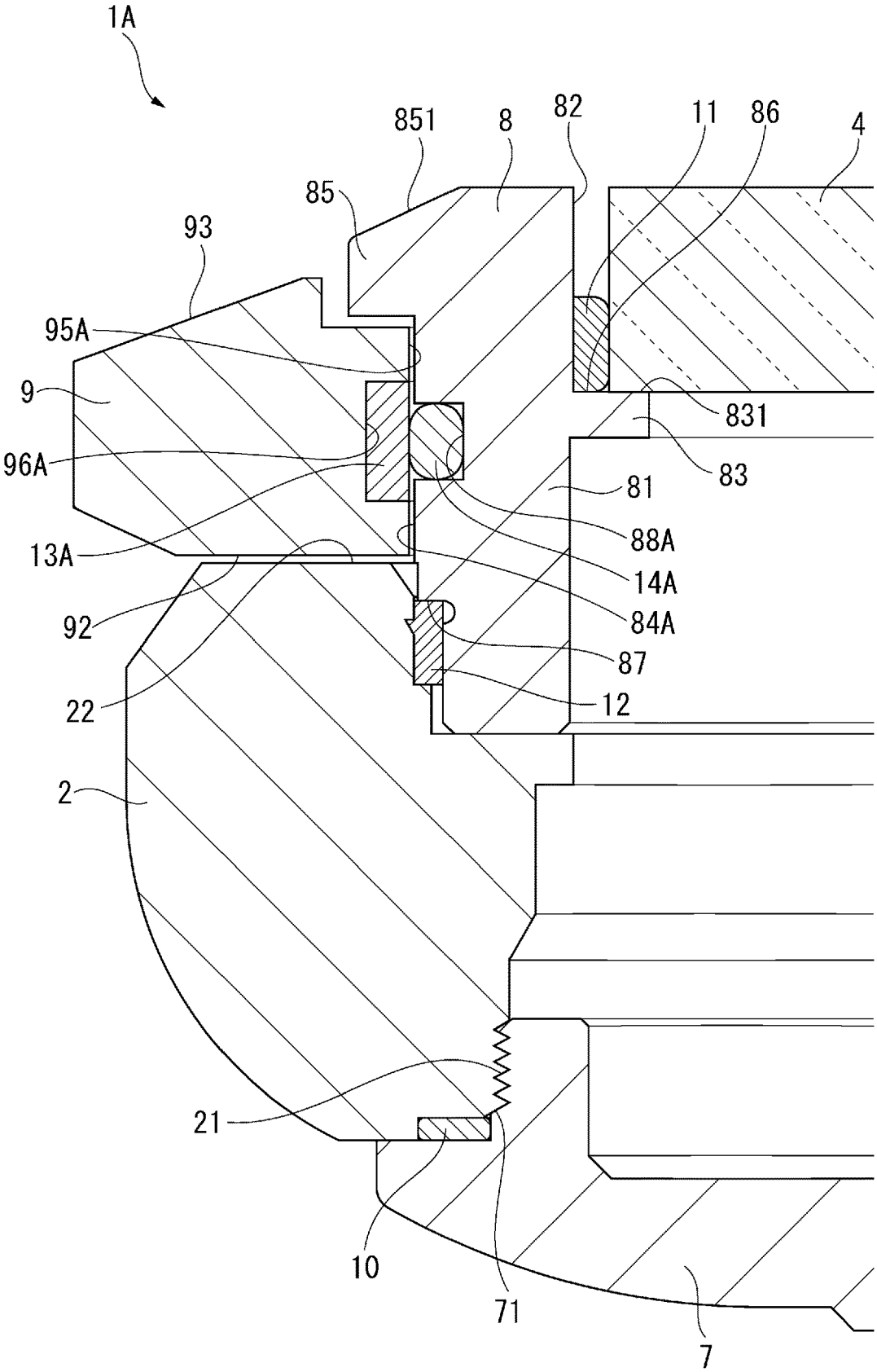
FIG. 4 is an enlarged cross-sectional view of a glass frame portion of a rotary bezel equipped timepiece according to a second embodiment of the invention.

A second embodiment of the invention will next be described with reference to FIG. 4. In the second embodiment, the same configurations as those in the first embodiment or configurations similar to those in the first embodiment have the same reference characters and will not be described.

In a rotary bezel equipped timepiece 1A according to the second embodiment, a resin member 13A is attached to a recessed groove 96A formed in an inner circumferential surface 95A of the rotary bezel 9, and a gasket 14A is disposed in a recessed groove 88A formed in an outer circumferential surface 84A of the glass frame 8. That is, the resin member 13A is attached to the inner circumferential surface 95A (recessed groove 96A) of the rotary bezel 9 and forms a sliding portion against which the gasket 14 slides when the rotary bezel 9 is rotated. That is, also in the present embodiment, the resin member 13A and the gasket 14A slide against each other when the rotary bezel 9 is rotated, whereby the same effects as those provided by the first embodiment described above can be provided.

The resin member 13A may be so attached as to be press-fit into the recessed groove 96A, or the outer circumferential surface of the resin member 13A may be so attached as to be bonded to the inner circumferential surface of the recessed groove 96A.

Variations

The invention is not limited to the embodiments described above, and variations, improvements, and other modifications to the extent that the advantage of the invention is achieved fall within the scope of the invention.

The rotary bezel equipped timepiece according to any of the embodiments of the invention is not limited to a timepiece having the world time function and the simple orientation indicator function and can be used as a wristwatch including a rotary bezel. For example, in the case of a diver's watch, numerals and markings corresponding to an indication hand of the timepiece are displayed as information in some cases, and the rotary bezel in any of the embodiments of the invention may be used to display the information. In this case, a plurality of grooves may be arranged in the lower surface of the rotary bezel along the circumferential direction, and a rotary bezel spring may be so disposed on the upper surface of the case body that the front end of the rotary bezel spring engages with any of the plurality of grooves to achieve a clicking sensation when the user rotates the rotary bezel. In the case of a chronograph timepiece, a rotary bezel with a circular slide rule for aviation measurement may be used. Further, only markings may be displayed on the rotary bezel 9, for example, in a case where the rotary bezel equipped timepiece is provided with a plurality of types of sensor and information pointed with the second hand 5A is changed by mode switching.

Information displayed on the glass frame is not limited to the letters representing the names of representative city in the world time zone and the numerals representing time differences from UTC and can be a variety of pieces of information in accordance with the purpose of the timepiece.

Further, the invention is not necessarily applied to a wristwatch and is applicable to a variety of timepieces each including a rotary bezel.

A method for fixing the glass frame 8 to the case body 2 is not limited to the method using the engaging stepped section 87 and the glass frame gasket 12 in each of the embodiments described above.

For example, a male threaded portion may be formed at a lower end portion of the outer circumferential surface 84 of the tubular section 81 of the glass frame 8, and a female threaded portion may be formed at an upper end portion of the inner circumferential surface of the case body 2. The male threaded portion of the glass frame 8 may then be caused to engage with the female threaded portion of the case body 2 to fix the glass frame 8 to the case body 2.

The glass frame 8 may instead be integrated with the case body 2.

The rotary bezel equipped timepieces 1 and 1A according to the embodiments described above each include the case body 2 and the case back 7 and may instead include a one-piece exterior case formed of the case body 2 and the case back 7 integrated with each other. That is, the invention is applicable to the timepiece including the one-piece case because the movement and other components cab be assembled into the case body 2 from the side facing the front surface of the case body 2 by removing the rotary bezel 9 and the glass frame 8, which holds the cover glass plate 4. Using the one-piece case allows improvement in waterproof capability.

In the rotary bezel equipped timepieces 1 and 1A according to the embodiments described above, the rotary bezel 9 is so disposed as to be rotatable in opposite directions relative to the glass frame 8 and may instead be so disposed as to be rotatable only in one direction.

Further, the resin members 13 and 13A are not necessarily made of a fluorine resin, such as polytetrafluoroethylene, unlike the embodiments described above. The resin members 13 and 13A may instead be made, for example, of a typical resin, such as a silicon resin, an ABS resin, and polycarbonate or may be made of a material that reduces the frictional force produced when the rotary bezel is rotated at the portion that slides against the the gasket, which is made, for example, of a synthetic resin or rubber material, as compared with a metal or ceramic material used as the material of the glass frame and the rotary bezel.

The entire disclosure of Japanese Patent Application No. 2017-236738, filed Dec. 11, 2017 is expressly incorporated by reference herein.

What is claimed is:

1. A rotary bezel equipped timepiece comprising:

a glass frame that holds a windshield member and in which a recessed groove is formed;

a rotary bezel so provided as to be rotatable relative to the glass frame;

a resin member embedded in the recessed groove formed in an outer circumferential surface of the glass frame; and a gasket disposed between the resin member and an inner circumferential surface of the rotary bezel.

2. The rotary bezel equipped timepiece according to claim 1, wherein the resin member is made of a fluorine resin.

3. The rotary bezel equipped timepiece according to claim 1, wherein the rotary bezel is rotatable in opposite directions relative to the glass frame.

4. The rotary bezel equipped timepiece according to claim 1, wherein at least any one of a letter, a numeral, a symbol, and a marking is displayed as information on the rotary bezel.

5. The rotary bezel equipped timepiece according to claim 1, wherein the resin member is surrounded on at least three sides by the glass frame and directly contacts the glass frame on the at least three sides.

6. A rotary bezel equipped timepiece comprising:

a glass frame that holds a windshield member;

a rotary bezel so provided as to be rotatable relative to the glass frame and in which a recessed groove is formed;

a resin member embedded in the recessed groove formed in an inner circumferential surface of the rotary bezel; and a gasket disposed between the resin member and an outer circumferential surface of the glass frame.

7. The rotary bezel equipped timepiece according to claim 6, wherein the resin member is made of a fluorine resin.

8. The rotary bezel equipped timepiece according to claim 6, wherein the rotary bezel is rotatable in opposite directions relative to the glass frame.

9. The rotary bezel equipped timepiece according to claim 6, wherein at least any one of a letter, a numeral, a symbol, and a marking is displayed as information on the rotary bezel.

10. The rotary bezel equipped timepiece according to claim 6, wherein the resin member is surrounded on at least three sides by the rotary bezel and directly contacts the rotary bezel on the at least three sides.

* * * * *